US009305692B2

(12) United States Patent
Kulesza

(10) Patent No.: US 9,305,692 B2
(45) **Date of Patent: *Apr. 5, 2016**

(54) IONIZATION BY MAGNETIC INDUCTION FOR NATURAL GAS

(71) Applicant: Roman Kulesza, Woodbridge (CA)

(72) Inventor: Roman Kulesza, Woodbridge (CA)

( * ) Notice: Subject to any disclaimer, the term of this patent is extended or adjusted under 35 U.S.C. 154(b) by 256 days.

This patent is subject to a terminal disclaimer.

(21) Appl. No.: 13/970,151

(22) Filed: Aug. 19, 2013

(65) Prior Publication Data

US 2014/0055222 A1 Feb. 27, 2014

Related U.S. Application Data

(63) Continuation-in-part of application No. 13/905,416, filed on May 30, 2013.

(60) Provisional application No. 61/692,871, filed on Aug. 24, 2012.

(51) Int. Cl.
*F02M 27/04* (2006.01)
*H01F 7/02* (2006.01)

(52) U.S. Cl.
CPC ..... *H01F 7/02* (2013.01); *F02M 27/045* (2013.01)

(58) Field of Classification Search
CPC ..... F02M 27/045; H01F 7/02
See application file for complete search history.

(56) References Cited

U.S. PATENT DOCUMENTS 4,188,296 A 2/1980 Fujita
4,711,271 A 12/1987 Weisenbarger et al.
4,716,024 A 12/1987 Pera
D299,266 S 1/1989 Kulish
4,933,151 A 6/1990 Song
4,995,425 A 2/1991 Weisenbarger et al.
5,124,045 A 6/1992 Janczak et al.
D331,274 S 11/1992 Kashani
5,329,911 A 7/1994 Jeong
5,331,807 A 7/1994 Hricak
5,348,050 A * 9/1994 Ashton ..... 210/222
5,359,979 A 11/1994 Anfinson et al.
D353,438 S 12/1994 Yuksel
5,500,121 A * 3/1996 Thornton et al. ..... 210/222
5,664,546 A 9/1997 De La Torre Barreiro
5,671,719 A 9/1997 Jeong
5,804,067 A 9/1998 McDonald et al.
5,829,420 A 11/1998 Kita et al.
5,882,514 A 3/1999 Fletcher
6,183,700 B1 2/2001 Jeong
6,405,719 B2 6/2002 Nozato (Continued)

*Primary Examiner* — David A Reifsnyder
(74) *Attorney, Agent, or Firm* — Buckingham, Doolittle & Burroughs, LLC

(57) ABSTRACT

A magnetic ionization device is disclosed that reduces harmful Greenhouse Gases produced by the incomplete combustion of liquid or gaseous fossil fuels and increases performance efficiency. The magnetic ionization device comprises a pair of brackets secured together around a natural gas line, and at least two permanent rare earth magnet secured to the pair of brackets. The pair of brackets each comprises an interior surface and an exterior surface, and are generally curved or C-shaped. Furthermore, the brackets comprise a recess for receiving a portion of a natural gas line. Once the permanent rare earth magnets are secured to the brackets, the brackets and magnets can be coated with plastic, powder metal, or any other suitable protective layer as is known in the art. The pair of brackets is then secured together around a natural gas line via plastic ties, nuts, bolts, and/or washers, etc.

11 Claims, 5 Drawing Sheets

(56) References Cited

U.S. PATENT DOCUMENTS

| | | | | |
|---|---|---|---|---|
| 6,890,432 | B1 | 5/2005 | Witz et al. | |
| 7,351,337 | B1 | 4/2008 | Milo et al. | |
| 7,767,081 | B2 | 8/2010 | Meeks | |
| 2011/0192713 | A1 | 8/2011 | Clements | |
| 2013/0327304 | A1* | 12/2013 | Kulesza | 123/538 |

* cited by examiner

IONIZATION BY MAGNETIC INDUCTION FOR NATURAL GAS

CROSS-REFERENCE

This application claims priority from Provisional Patent Application Ser. No. 61/692,871 filed Aug. 24, 2012, and is a continuation-in-part of Utility patent application Ser. No. 13/905,416 filed May 30, 2013.

BACKGROUND

During the process of fuel combustion, such as in the consumption of natural gas, incomplete combustion can produce dangerous amounts of Greenhouse Gases. Other dangerous emissions can be harmful to both individual health and the atmosphere. Other systems for promoting complete combustion at the pre-ignition stage may be vulnerable to heat, vibration, design, build, installation, or other flaws. A system that utilizes permanent magnets to reduce excess emissions from fossil fuel combustion at the molecular level is necessary.

The present invention reduces harmful emissions and Greenhouse Gases while decreasing operational costs. The magnetic ionization device uses permanent magnets of rare earth metallurgy to increase the life span of magnetic flux production. By applying magnetic fields with the proprietary application using permanent magnets, results in the reduction of carbon monoxide emissions to near zero ppm within two hours. This device can also be used by the petroleum oil pipeline industry to decrease fouling caused by wax build up, as well as to inhibit bio-fouling and corrosion over time. Other emissions can be proportionately reduced, as well. For example, field tests showed that on the $57^{th}$ day of installation of a large NG perimeter hot water heater boiler inside a large institutional building, data was produced indicating reduced NG consumption and its CO2 equivalent of 9 percent to 15 percent. Additionally, this device's non-invasive application does not void the manufacturer's warranty, and enhances combustion at the molecular level.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a magnetic ionization device that reduces harmful Greenhouse Gases produced by the incomplete combustion of fossil fuels. The magnetic ionization device comprises a pair of brackets secured together around a natural gas line, and at least one permanent rare earth magnet secured to the pair of brackets. The pair of brackets each comprises an interior surface and an exterior surface, and are generally curved or C-shaped. Furthermore, the brackets comprise a recess for receiving a portion of a natural gas line. Once the permanent rare earth magnets are secured to the brackets, the brackets and magnets can be coated with plastic, powder metal, or any other suitable protective layer as is known in the art, that protects the magnets from harsh environments. The pair of brackets is then secured together around a natural gas line via plastic ties, nuts, bolts, and/or washers, etc.

In a preferred embodiment, the brackets comprise recesses of different sizes, which allow the brackets to enclose natural gas lines of different diameters. The brackets can then be positioned on either side of a natural gas line such that the interior surface of the brackets contact each other, enclosing the natural gas line, with larger brackets being used for natural gas lines of larger diameter and smaller brackets being used for natural gas lines of smaller diameter. Further, the pair of brackets is typically secured together around the natural gas line prior to where the natural gas line connects to the combustion chamber.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
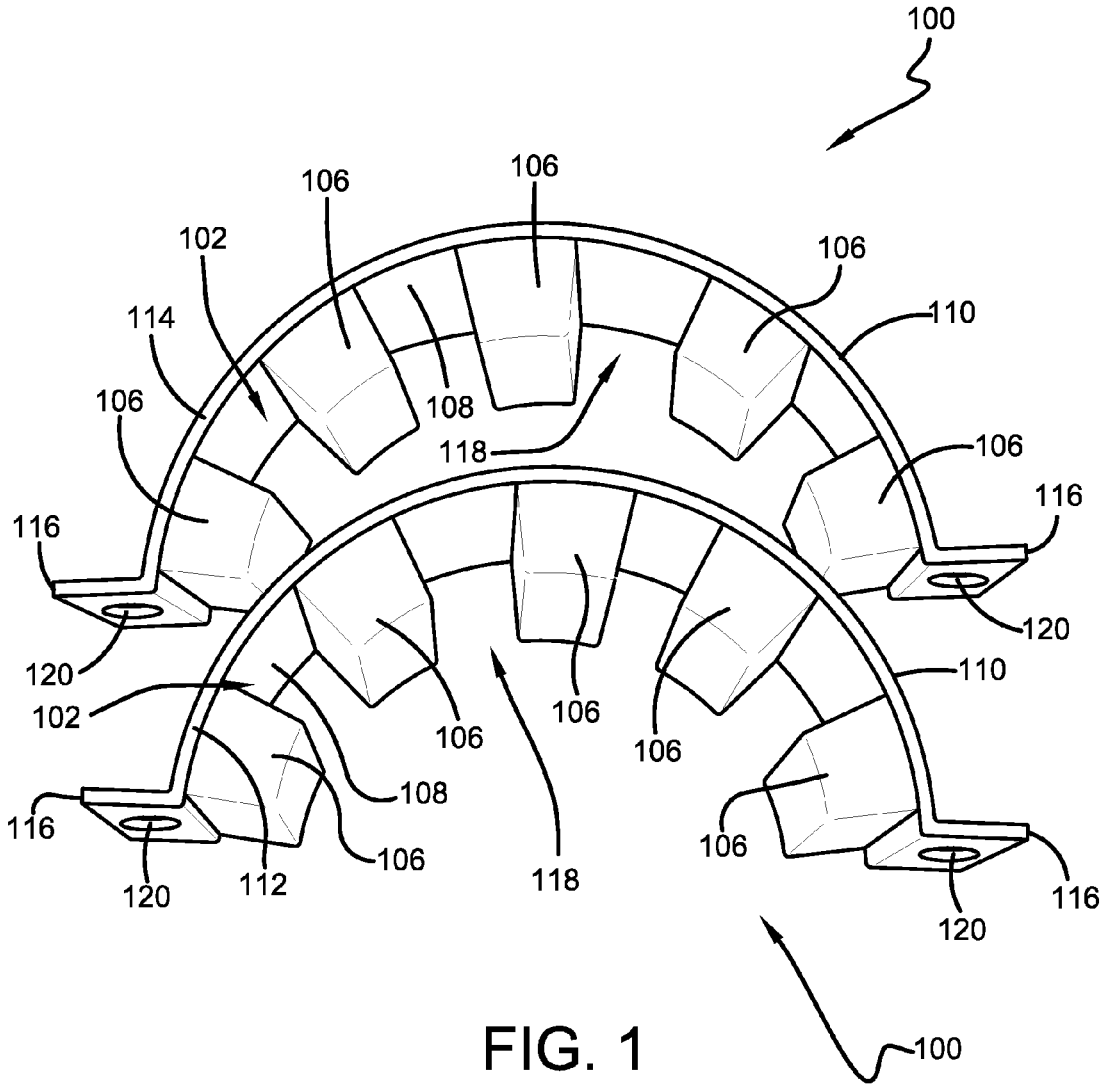
FIG. 1 illustrates a front perspective view of the magnetic ionization device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses a magnetic ionization device that reduces harmful emissions and Greenhouse Gases while decreasing operational costs. The magnetic ionization device uses permanent magnets of rare earth metallurgy to increase the life span of magnetic flux production. By applying magnetic fields with the proprietary application using permanent magnets, results in the reduction of carbon monoxide emissions to near zero ppm within two hours. This device uses permanent rare, earth magnets, designed with physics, chemistry, and current metallurgical market availability of Lanthanide series with atomic numbers 57 to 71 in the periodic table, commonly known as the rare earth elements. Cobalt and/or Boron may also be included in the mix. The advantage of rare earth compounds over other magnets is that their crystalline structures have magnetic anisotropy. This means that a crystal of the material is very easy to magnetize in one particular direction, but resists being magnetized in any other direction. Additionally, it retains high magnetic moments in the solid state. The magnetization is also done during the heat treating process. This device can also be used by the petroleum oil pipeline industry to decrease fouling caused by wax build up, as well as to inhibit biofouling and corrosion over time. Other emissions can be proportionately reduced, as well. Further, this device's non-invasive application does not void the manufacturer's warranty, and enhances combustion at the molecular level.

The disclosed magnetic ionization device comprises a pair of brackets secured together around a natural gas line, and at least one permanent rare earth magnet secured to the pair of brackets. The pair of brackets each comprises an interior surface and an exterior surface, and are generally curved or C-shaped. Furthermore, the brackets comprise a recess for receiving a portion of a natural gas line. Once the permanent rare earth magnets are secured to the brackets, the brackets and magnets can be coated with plastic, powder metal, or any other suitable protective layer as is known in the art. The pair of brackets is then secured together around a natural gas line via plastic ties, nuts, bolts, and/or washers, etc.

Figure 2:
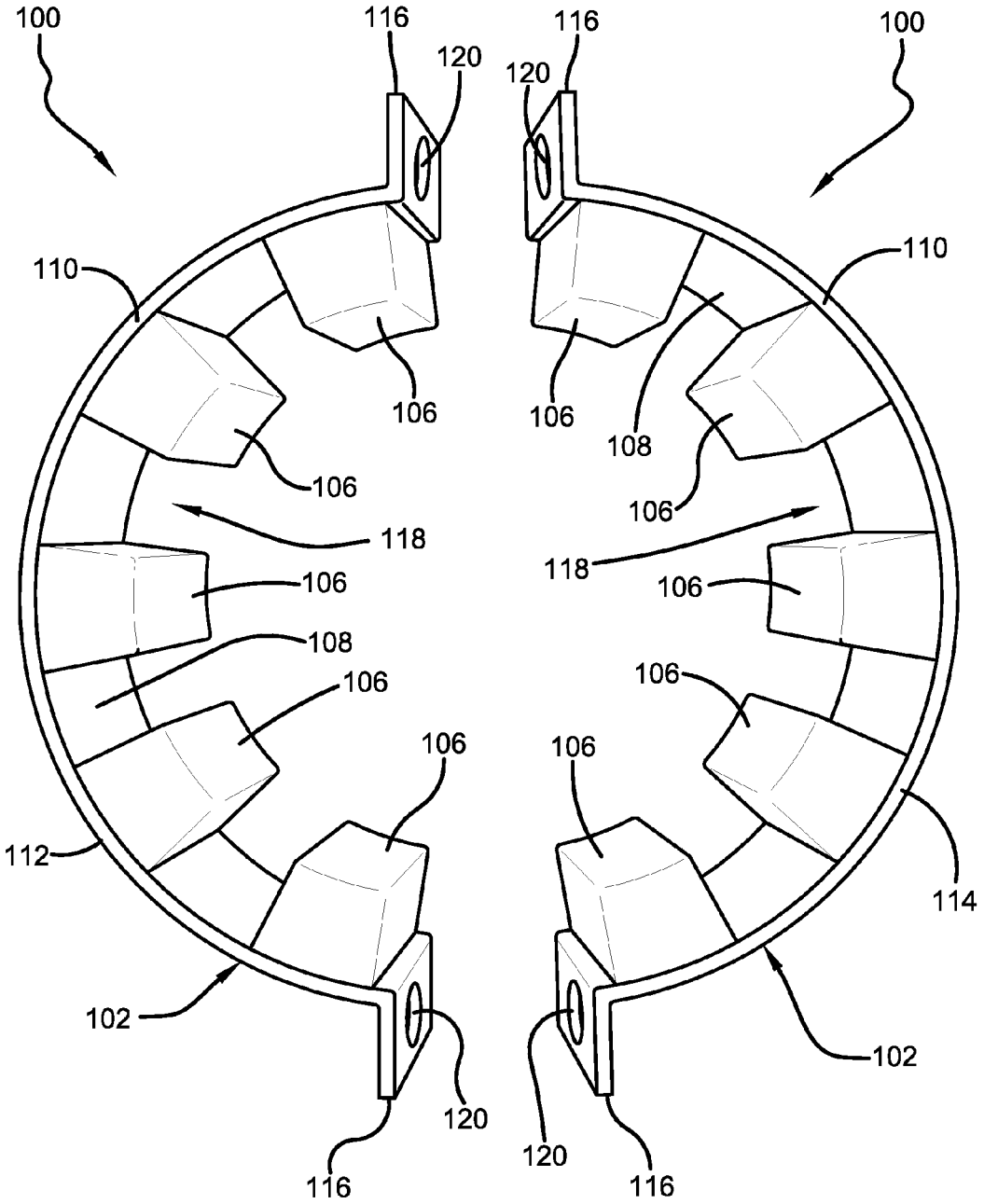
FIG. 2 illustrates a front perspective view of the magnetic ionization device turned approximately 90 degrees in accordance with the disclosed architecture.

Referring initially to the drawings, FIGS. 1-2 illustrate the magnetic ionization device 100 that reduces harmful Greenhouse Gases produced by the incomplete combustion of fossil fuels. The magnetic ionization device 100 comprises a pair of brackets 102 secured together around a natural gas line 104, and at least one permanent rare earth magnet 106 secured to the pair of brackets 102 (as shown in FIG. 1).

The pair of brackets 102 each comprises an interior surface 108 and an exterior surface 110. Typically, each of the brackets 102 are curved, C-shaped, or crescent shaped, however any other suitable shape can be used as is known in the art without affecting the overall concept of the invention. The brackets 102 would generally be constructed of steel, iron, etc., though any other suitable ferrous material may be used to manufacture the brackets 102 as is known in the art without affecting the overall concept of the invention.

The brackets 102 can also comprise a variety of colors and designs to suit user and manufacturing preference, and can be manufactured in a variety of sizes depending on the wants and needs of a user (as shown in FIGS. 1-4. The brackets 102 are approximately between 6.0 and 16.0 inches long as measured from a first end 112 to a second end 114, approximately between 2.5 and 3.0 inches wide as measured from opposing sides 116, and approximately between 0.0598 inches (16 gauge) and 0.0747 inches (14 gauge) thick, as measured from the interior surface 108 to the exterior surface 110 at its farthest opposing point.

Figure 3:
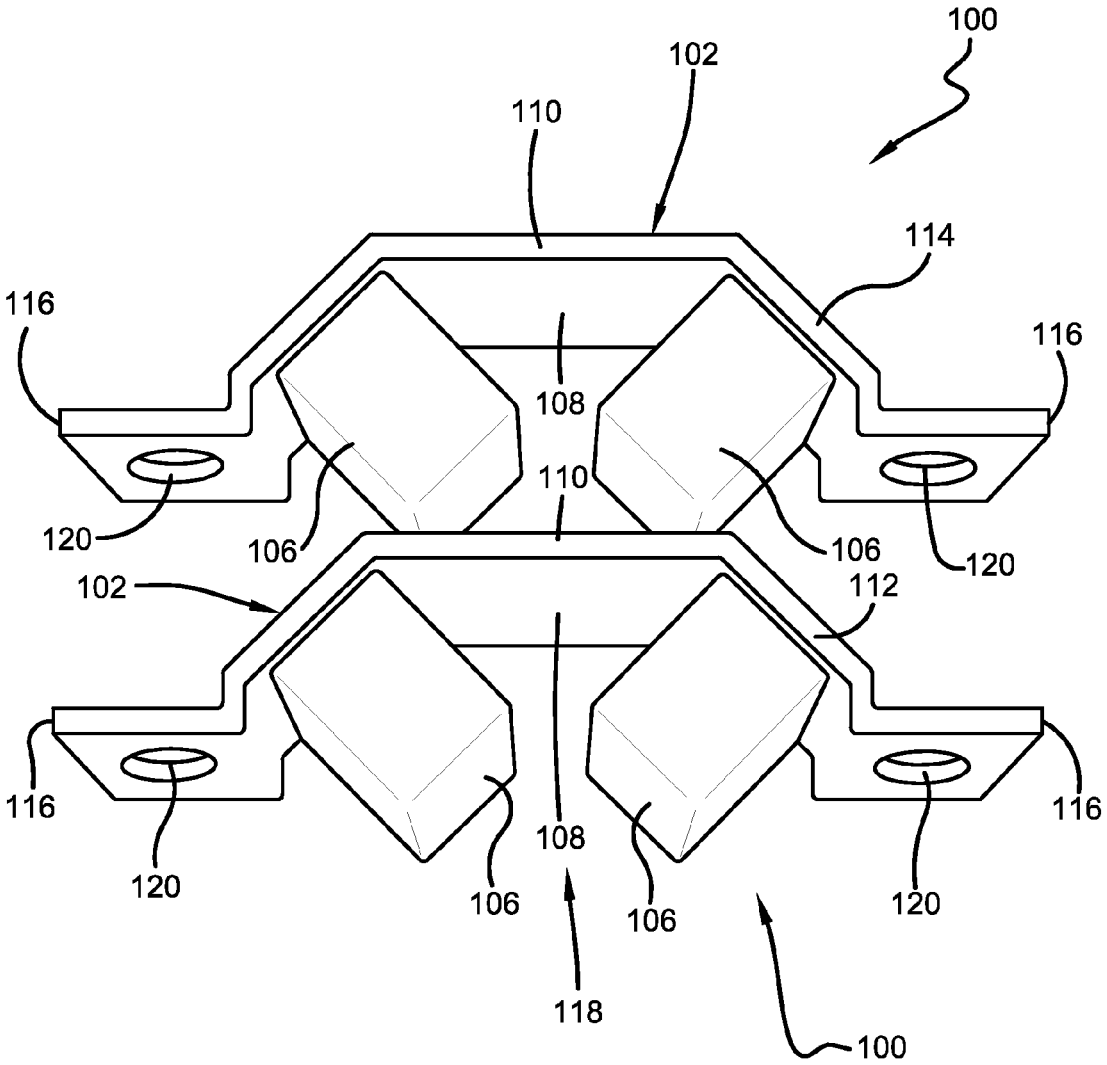
FIG. 3 illustrates a front perspective view of a magnetic ionization device with a smaller diameter in accordance with the disclosed architecture.
Figure 4:
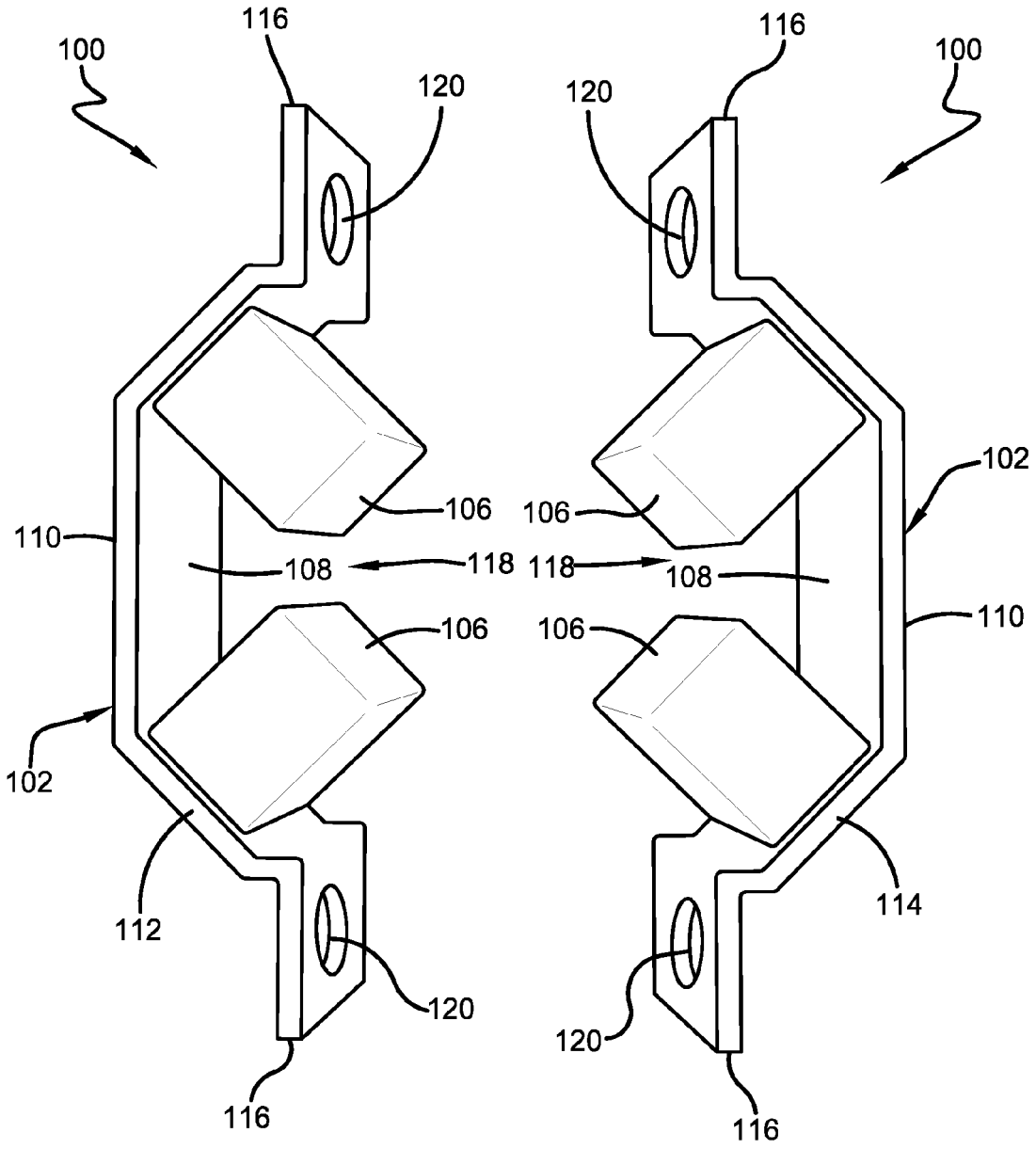
FIG. 4 illustrates a front perspective view of the magnetic ionization device with a smaller diameter turned approximately 90 degrees in accordance with the disclosed architecture.
Figure 5:
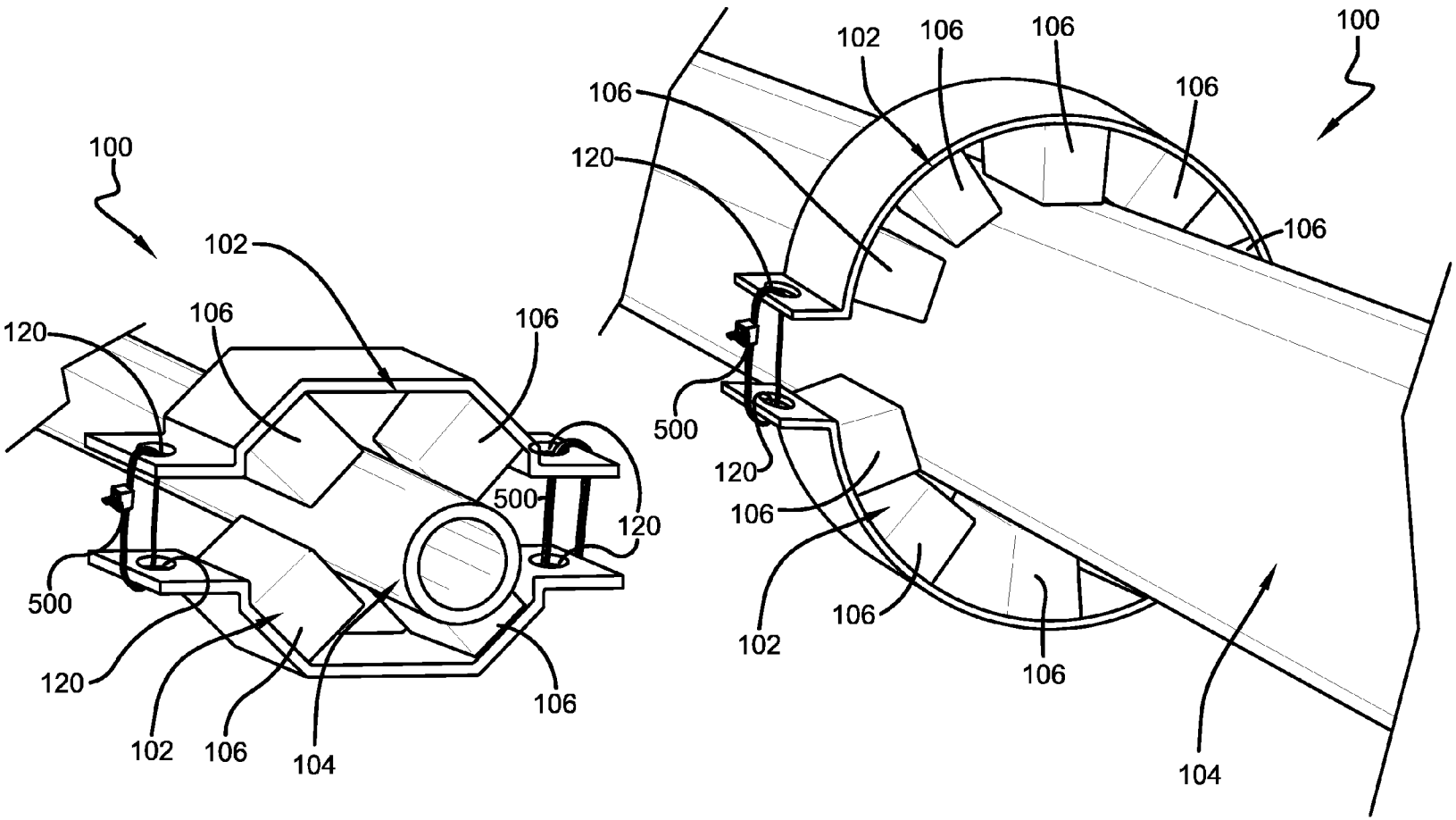
FIG. 5 illustrates a perspective view of a magnetic ionization device in use in accordance with the disclosed architecture.

Typically, the brackets 102 are used in pairs, but they do not have to be and the device 100 can function with only one bracket 102, although the device 100 performs more efficiently with a pair of brackets 102 (as shown in FIG. 5). Furthermore, the brackets 102 comprise a recess 118 for receiving a portion of a natural gas line 104. The brackets 102 can comprise recesses 118 of different sizes, which allow the brackets 102 to enclose natural gas lines 104 of different diameters. For example, FIGS. 1-2 illustrate brackets 102 for enclosing larger diameters of natural gas lines 104, and FIGS. 3-4 illustrate brackets 102 for enclosing smaller diameters of natural gas lines 104. Further, only one bracket 102 can be used with a metal back plate (not shown) if space considerations limit the installation.

The magnetic ionization device 100 further comprises at least two permanent rare earth magnets 106 secured to the pair of brackets 102. In a preferred embodiment, there are a plurality permanent earth magnets 106 secured to the pair of brackets 102, however any suitable number of permanent earth magnets 106 can be used with the magnetic ionization device 100 as is known in the art without affecting the overall concept of the invention. The permanent rare earth magnets 106 are typically secured to the interior surface 108 of each bracket 102 via magnetic attraction. However, the permanent rare earth magnets 106 can be secured to any suitable position on the exterior surface 110 and/or the interior surface 108 of the brackets 102. The permanent rare earth magnets 106 can also be secured to the brackets 102 via any suitable securing means as is known in the art.

The permanent rare earth magnets 106 are designed with physics, chemistry, and metallurgy, such that during the heat treating process the magnetizing of the rare earth metal is introduced. Typically, only the south exiting pole of the magnets 106 is used for proper application facing the natural gas line 104. The south pole is defined by the north needle of a compass being attracted to the south pole. North pole of the magnets 106 attaches to the inside of the metal bracket 102. Neodymium magnets have been replacing ALNICO (Aluminum, Nickel, and Cobalt) and Ferrite in many applications. Modern technology requires powerful magnets. The greater strength of the magnets 106 allows for smaller, lighter magnets to be used for this application which also depends on market availability of Cobalt, Boron and Lanthanides.

In a preferred embodiment, the permanent rare earth magnets 106 comprise Neodymium Iron Boron (NdFeB), Iron-Boron, and/or Samarium Cobalt (SmCo), ($Nd_2Fe_{14}B$), and ($SmCo_5$), though any other suitable magnets can be used as is known in the art without affecting the overall concept of the invention. The advantage of rare earth metals, is that the rare earth metals will not lose or diminish magnetic flux strength from small motor vibrations or of an accidental shock or blow by a hard object.

Once the permanent rare earth magnets 106 are secured to the brackets 102, the brackets 102 and magnets 106 can be coated with a protective layer to protect the magnets 106 from corrosion and the metal brackets 102 from rusting. The brackets 102 and magnets 106 can be coated in plastic, powder metal, or any other suitable protective layer as is known in the art.

A pair of brackets 102 is then secured together around a natural gas line 104. Typically, the pair of brackets 102 is secured together via plastic ties 500, nuts, bolts, and/or washers, etc., or any other suitable securing means as is known in the art. Specifically, the pair of brackets 102 are positioned on either side of a natural gas line 104 such that the interior surface 108 of the brackets 102 contact each other, enclosing the natural gas line 104. Further, openings (or holes) 120 on the edges of the brackets 102 are aligned and plastic ties 500 or nuts, bolts, and washers (not shown) are threaded through the openings 120 and fastened, securing the pair of brackets 102 together.

Further, the pair of brackets 102 are secured together around the natural gas line 104 before a combustion chamber (not shown), or at any other suitable position on a natural gas line 104. In a preferred embodiment, the brackets 102 are secured together around the natural gas line 104 before the combustion chamber so that the magnetic effects are better realized before it reaches the combustion chamber. In some cases stray eddy currents should be shunted before and after the installed brackets 102 to prevent irregularities of the flux field saturation process.

Typically, the natural gas line 104 is a 1 inch diameter, or a 4 inch diameter pipe feeding the combustion chamber. Ionization by Magnetic Induction (IMI) for a 6 inch diameter feed pipe can occur, but it requires a turbo charging of the magnetic flux field. IMI custom built units are needed for a greater exposure time in milliseconds, to be effective according to the laws of physics and velocity. In a situation, where there are double block and bleed valves before the combustion chambers or open areas for different natural gas appliances, users should install the brackets 102 at least 12 inches upstream away from these safety valves.

Further, as stated supra, the brackets 102 can be different sizes to accommodate natural gas lines 104 of different diameters (as shown in FIGS. 1-4). Thus, the different sizes of brackets 102 can accommodate natural gas line variations from 1 inch diameter, 4 inch diameter, or 6 inch diameter, etc. Flexible natural gas line connectors may reduce magnet effectiveness by an unknown small percentage. However, compensation for this variance can be overcome by installing another magnetic device 100 on the solid natural gas line before the metal flexible connector. Further, each device 100 can be custom built for a user's need and/or desire.

Additionally, any suitable number of brackets 102 can be secured to a natural gas line 104, although the brackets 102 are typically positioned in pairs. Generally, the more brackets 102 that are secured to the natural gas line 104 and utilized cause an increase in efficiency, such that more neutral molecules of oxygen are attracted for a better combustion within a shorter period of time. Thus, resulting in accelerated temperature (delta) increases by proven independent laboratory tests within minutes of approximately 6.3 F to 50 F degrees. Specifically, this device 100 reduces the toxic effects of Greenhouse Gas (GHG) emissions while increasing the performance efficiency by polarizing or charging natural gas molecules so that natural gas (Methane CH4) and other similar gases near this chain of molecules such as the higher BTU (British thermal unit) rated propane, etc., bonds with oxygen molecules improving gas burning efficiency through a magnetic anisotropy (meaning direction dependent).

FIGS. 3-4 illustrate different size brackets 102 of the magnetic ionization device 100. For example, FIGS. 1-2 illustrate brackets 102 for enclosing larger diameters of natural gas lines 104, and FIGS. 3-4 illustrate brackets 102 for enclosing smaller diameters of natural gas lines 104. As stated supra, the brackets 102 comprise a recess 118 for enclosing a portion of a natural gas line 104. The brackets 102 can comprise recesses 118 of different sizes, which allow the brackets 102 to enclose natural gas lines 104 of different diameters. Thus, the different sizes of brackets 102 can accommodate 1 inch diameter, 4 inch diameter, or 6 inch diameter natural gas lines 104. Further, each device 100 can be custom built for a user's need and/or desire.

FIG. 5 illustrates the magnetic ionization device 100 in use. In operation, a user (not shown) would choose the size and/or the amount of magnetic ionization devices 100 that meets their needs and/or wants. The user would then determine what type of natural gas line 104 to secure the device 100 to. The user then positions the brackets 102 of the device 100 on either side of the natural gas line 104, enclosing the natural gas line 104. Specifically, the user positions the brackets 102 such that the interior surface 108 of the brackets 102 which contain the permanent rare earth magnets 106 contact each other, enclosing the natural gas line 104. Typically, the user positions the brackets 102 before the combustion chamber on the natural gas line 104. Ideal positioning should include avoiding electromagnetic interference from high voltage lines or panels of 220 volts by approximately three feet in all directions.

Once positioned, the user then secures the brackets 102 together, via the use of plastic ties 500, nuts, bolts, and/or washers. Specifically, the user inserts the plastic ties 500 (or nuts, bolts, and/or washers) through the openings 120 of the brackets 102 and fastens them, securing the pair of brackets 102 together. The user then determines whether to apply more brackets 102 to the natural gas line 104. The user can then position the additional brackets 102 in pairs along the natural gas line 104, before the combustion chamber, and can secure the brackets 102 via the plastic ties 500, nuts, bolts, and/or washers. The user then utilizes the natural gas line 104 per normal operation.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A magnetic ionization device comprising:

at least one permanent rare earth magnet comprised of Lanthanide series magnets with atomic numbers 57 to 71 in periodic table; and a pair of steel brackets attached to a natural gas line; and wherein the pair of steel brackets comprise an interior surface, an exterior surface, and are C-shaped in shape, and comprise a recess for receiving a portion of the natural gas line; and wherein the at least one permanent rare earth magnet is attached to the interior surface of the pair of brackets via magnetic attraction; and wherein only south poles of the at least one permanent rare earth magnet is applied facing the natural gas line, and north poles of the at least one permanent rare earth magnet attach to the interior surface of the pair of steel brackets.

2. The device of claim 1, wherein the pair of brackets and the at least one permanent rare earth magnet are coated in plastic.

3. The device of claim 1, wherein the pair of brackets and the at least one permanent rare earth magnet are coated in powder metal.

4. The device of claim 1, wherein the pair of brackets are secured together around the natural gas line via at least one of plastic ties, nuts, bolts, or washers.

5. The device of claim 1, wherein there is a plurality of permanent rare earth magnets secured to the bracket.

6. The device of claim 1, wherein the bracket is secured to the natural gas line before a combustion chamber.

7. A magnetic ionization device comprising:

a plurality of permanent rare earth magnets comprised of Lanthanide series magnets with atomic numbers 57 to 71 in periodic table; and a pair of steel brackets comprising an interior surface and an exterior surface and are C-shaped in shape, and comprise a recess for receiving a portion of the natural gas line; and wherein the plurality of permanent rare earth magnets are secured to the interior surface via magnetic attraction, and then the pair of brackets and the plurality of permanent rare earth magnets are coated in powder metal; and wherein the interior surface of the pair of brackets is then secured together around a natural gas line; and wherein only south poles of the plurality of permanent rare earth magnets are applied facing the natural gas line, and north poles of the plurality of permanent rare earth magnets attach to the interior surface of the pair of steel brackets.

8. The device of claim 7, wherein the pair of brackets are secured together via at least one of plastic ties, nuts, bolts, or washers.

9. The device of claim 7, wherein the pair of brackets are secured together around the natural gas line before a combustion chamber.

10. A magnetic ionization device comprising:

a plurality of permanent rare earth magnets comprised of Lanthanide series magnets with atomic numbers 57 to 71 in periodic table; and a pair of steel brackets comprising an interior surface and an exterior surface surface, and are C-shaped in shape, and comprise a recess for receiving a portion of the natural gas line; and wherein the plurality of permanent rare earth magnets are secured to the interior surface via magnetic attraction, and then the pair of brackets and the plurality of permanent rare earth magnets are coated in plastic; and wherein the interior surface of the pair of brackets is then secured together around a natural gas line before a combustion chamber; and wherein only south poles of the plurality of permanent rare earth magnets are applied facing the natural gas line, and north poles of the plurality of permanent rare earth magnets attach to the interior surface of the pair of steel brackets.

11. The device of claim 10, wherein the pair of steel brackets are secured together via at least one of plastic ties, nuts, bolts, or washers.

* * * * *